US006820675B2

(12) United States Patent
Nakatani

(10) Patent No.: US 6,820,675 B2
(45) Date of Patent: Nov. 23, 2004

(54) SASH SYSTEM HAVING DOORS BEING OPENABLE AND CLOSABLE BY SLIDING AND FOLDING

(76) Inventor: Kazumaro Nakatani, 63-7 Ko, Ikegami, Mikuni-cho, Sakai-gun, Fukui-ken (JP)

( * ) Notice: Subject to any disclaimer, the term of this patent is extended or adjusted under 35 U.S.C. 154(b) by 0 days.

(21) Appl. No.: 10/350,648

(22) Filed: Jan. 24, 2003

(65) Prior Publication Data

US 2003/0141022 A1 Jul. 31, 2003

(30) Foreign Application Priority Data

Jan. 25, 2002 (JP) ..... 2002-017046
Jul. 15, 2002 (JP) ..... 2002-205256

(51) Int. Cl.[7] ..... E06C 7/16
(52) U.S. Cl. ..... 160/118; 160/206
(58) Field of Search ..... 160/118, 113, 160/201, 206, 210, 212, 194, 84.01; 52/71

(56) References Cited

U.S. PATENT DOCUMENTS

| | | | | | |
|---|---|---|---|---|---|
| 1,345,669 | A | | 7/1920 | Gibbons | |
| 2,408,525 | A | * | 10/1946 | Miller et al. | 160/36 |
| 2,637,381 | A | * | 5/1953 | Bowman | 160/40 |
| 2,771,133 | A | * | 11/1956 | Haskell | 160/89 |
| 3,361,189 | A | * | 1/1968 | Dixon et al. | 160/231.2 |
| 3,570,579 | A | * | 3/1971 | Matsushima | 160/235 |
| 4,296,791 | A | * | 10/1981 | Chaumat et al. | 160/206 |
| 4,534,395 | A | * | 8/1985 | Carroll | 160/199 |
| 4,747,441 | A | * | 5/1988 | Apolzer et al. | 160/206 |
| 6,021,839 | A | * | 2/2000 | Knezevich et al. | 160/183 |
| 6,296,038 | B1 | * | 10/2001 | Chen | 160/199 |
| 2001/0037613 | A1 | * | 11/2001 | Owens | 52/71 |

FOREIGN PATENT DOCUMENTS

| | | |
|---|---|---|
| FR | 910 316 A | 6/1946 |
| GB | 1 589 950 A | 5/1981 |
| JP | 2001 234668 A | 8/2001 |
| JP | 2001-280018 A | 10/2001 |

OTHER PUBLICATIONS

Patent Abstracts Of Japan, vol. 2002, No. 02 (Apr. 2, 2002).
Patent Abstracts Of Japan, vol. 2000, No. 25 (Apr. 12, 2001).
Patent Abstracts Of Japan, vol. 2002, No. 09 (Sep. 4, 2002).

* cited by examiner

*Primary Examiner*—Bruce A. Lev
(74) *Attorney, Agent, or Firm*—Quarles & Brady LLP

(57) ABSTRACT

A sash system comprises a pair of sash doors including an inner sash door and an outer sash door; an upper sash frame and a lower sash frame; and an inner guide rail built in the upper frame and an outer guide rail built in the lower frame, the door front frame and the door end frame corresponding to each sash door being engaged with the inner guide rail and with the outer guide rail, respectively. Each of the sash doors includes a vertical door front frame, a vertical door end frame, and a pair of horizontal divider panels joined by an intermediate locking frame and connecting the door front frame and the end frame. The intermediate interlocking frame being foldable with respect to a vertical shaft thereof, and is engaged so as to be detachable from each guide rail or from an interlocking frame guide rail in parallel to each guide rail.

20 Claims, 7 Drawing Sheets

SASH SYSTEM HAVING DOORS BEING OPENABLE AND CLOSABLE BY SLIDING AND FOLDING

CROSS REFERENCES TO RELATED APPLICATIONS

This application claims the priority benefit of Japanese Patent Application No. 2002-017046 filed on Jan. 25, 2002 and Japanese Patent Application No. 2002-205256 filed on Jan. 15, 2002.

STATEMENT REGARDING FEDERALLY SPONSORED RESEARCH

Not Applicable.

BACKGROUND OF THE INVENTION

1. Field of the Invention

The present invention relates to a sash system having doors, each being freely opened and closed by sliding and folding. More particularly, the present invention relates to an improved sliding sash system having an inner sash door and an outer sash door, each of which can be operated through selecting a sliding open/close mode or a folding open/close mode.

2. Description of the Prior Art

Conventional sash systems of the type, which can be arbitrarily opened and closed through sliding and folding, are well known in Japanese Patent Laid-open publication No. 2001-280018 previously proposed by the present applicant.

In this related art, the sash system has two sash doors including an inner sash door and an outer door sash inside a sash frame. The sash doors are mounted and mutually slidable inside the sash frame integrally assembled in a rectangular form. This sash system has the following structure.

That is, each sash door has a vertical door front frame disposed at the left end thereof, a vertical door end frame disposed at the right end thereof, a horizontal divider panel connecting the door front frame and the door end frame, and a vertical intermediate interlocking frame. The vertical intermediate interlocking frame is disposed at the intermediate portion of the divider panel so as to be two-folded with respect to a rotational shaft. Moreover, the sash frame has an upper frame in which a pair of upper guide rails are built and a lower frame in which a pair of lower guide rails are built. In each sash door, the shaft at the upper end of the door front frame, the shaft at the upper end of the door end frame, and the shaft at the upper end of the intermediate interlocking frame are engaged to the upper guide rails. The shaft at the lower end of the door front frame, the shaft at the lower end of the door end frame, and the shaft at the lower end of the intermediate interlocking frame are engaged to the lower guide rails. The upper shaft of the door front frame is always engaged to the corresponding upper guide rail. The lower shaft of the door front frame is always engaged to the corresponding lower guide rail. The upper shaft of the door end frame is always engaged to the corresponding upper guide rails. The lower shaft of the door end frame is always engaged to the corresponding lower guide rails. The upper shaft of the intermediate interlocking frame can be engaged or disengaged at the position where the corresponding upper guide rail is set. The lower shaft of the intermediate interlocking frame can be engaged or disengaged at the position where the corresponding lower guide rail is set.

In the sash system with the above-mentioned structure, the sash doors can be arbitrarily opened and closed mutually by a sliding operation, with the intermediate interlocking frame engaged to the upper and lower guide rails and with each sash door expanded. With the intermediate interlocking frame disengaged from the upper and lower guide rails, each sash door can be opened and closed arbitrarily in a two-fold state.

Each sash door operates in the two use modes of sliding and folding. That is, the upper end shaft of the door front frame is engagable to and disengagable from the upper guide rail and the lower end shaft of the door end frame is engagable to and disengagable from the lower guide rail. With such an engagement/disengagement function, an engagement/disengagement mechanism, for example, formed of an espagnolette and a lever handle, is mounted to an intermediate interlocking frame. The operation of the engagement/disengagement mechanism causes a vertical movement of an L-shaped slider disposed on the indoor side of each intermediate interlocking frame, so that desired engagement and disengagement is achieved.

By operating the engagement/disengagement mechanism located on the intermediate interlocking frame, the intermediate interlocking frame of each sash door is engaged to and disengaged from each upper guide rail while being engaged to and disengaged from each lower guide rail. For that reason, it is not needed to newly machine the upper frame, the lower frame, or the guide rail in a sash frame. In the sash structure, the airtight holding means can easily maintain high air-tightness in a manner similar to that of the conventional double sliding sash system.

After all, the sash system, having an inner sash door and an outer sash door to one sash frame, has the folded opening/closing function, together with the conventional double sliding function maintained in the opening/closing of each sash door. For that reason, the sash system has the advantage of realizing the folded opening/closing function or selectively fully opening, if necessary, a window, in addition to the general double sliding function.

However, in the above-mentioned sash system, the engagement/disengagement mechanism, which changes from opening/closing through sliding and opening/closing through folding, becomes complicated. Moreover, there is an unfavorable problem in that building the engagement/disengagement means in the intermediate interlocking frame leads to a complicated structure.

SUMMARY OF THE INVENTION

The present invention is made to solve the above-mentioned problems.

An object of the invention is to provide a sash system that can maintain an air-tightness equivalent to (or substantially equivalent to) that of a conventional double-sliding sash system.

Another object of the present invention is to provide an improved sash system that has a simplified engagement/disengagement mechanism. The engagement/disengagement mechanism can selectively provide quickly, easily and reliably the use mode of sliding sash doors engaged by an intermediate interlocking frame along a guide rail or the use mode of folding sash doors disengaged from a guide rail.

In order to solve the conventional problems and to achieve the object of the present invention, the present invention re-studied air-tightness of the sash system of the type which is opened and closed by sliding. With the inner sash door and the outer inner door closed by sliding, the air tightness of the sash system is generally achieved using airtight members. The air tight member is inserted between the upper, lower, right, and left sides of a sash frame and the contact portions between the sash frame and each sash door, or is inserted between door end frames. The present invention paid attention to the fact that the air-tightness is maintained in a closed state of each sash door.

The contact surfaces between sash doors disposed in a closed state may maintain air-tightness in the elongated direction of the upper and lower frames of a sash frame or in the elongated direction of each guide rail. However, it is obvious that other elongated portions of the upper and lower frames and the elongated portions of each guide rail, that is, the outdoor portion and the indoor portion of the inner sash door and the outer sash door disposed in a closed state do not work to maintain air-tightness. The non-airtight maintaining portion is used to engage and disengage the intermediate interlocking frame of each sash door to each guide rail. In other words, the upper and lower shafts of an intermediate interlocking frame are engaged and disengaged by means of a communicating path, such as a cutaway portion, formed in each guide rail. By doing so, the present invention found that the upper and lower frames and the guide rails can be easily and certainly machined. The present invention further found that both engagement of each guide rail to an intermediate interlocking frame and disengagement of an intermediate interlocking frame from each guide rail can be performed quickly, simply and certainly.

According to the present invention, based on the above-mentioned knowledge, the intermediate interlocking frame can be engaged to or disengaged from a guide rail, with sash doors in an open state where no air-tightness or no airtight holding means can be obtained.

That is, according to the present invention, a sash system, wherein sash doors are opened and closed by sliding and folding, comprises a pair of sash doors including an inner sash door and an outer sash door, each of the sash doors including a vertical door front frame disposed on the right end of each sash door, a vertical door end frame disposed on the left end of each sash door, a horizontal divider panel connecting the door front frame and the end frame, and an intermediate interlocking frame disposed to a horizontal intermediate portion of the divider panel, the intermediate interlocking frame being two-folded horizontally with respect to a rotational shaft thereof; an upper sash frame and a lower sash frame; and an inner guide rail built in the upper frame and an outer guide rail built in the lower frame, the door front frame and the door end frame corresponding to each sash door being always engaged with the inner guide rail and with the outer guide rail, respectively. The intermediate interlocking frame is engaged so as to be detachable from each guide rail or from an interlocking frame guide rail in parallel to each guide rail. The sash system can arbitrarily select a first mode and a second mode, the first mode in which the sash doors are slidably opened and closed in an intermediate interlocking frame engaged state and the second mode in which each of the sash doors are folded in an intermediate interlocking frame disengaged state. The position where an intermediate interlocking frame in each sash door is engaged to and disengaged from each guide rail is set to the position where the sash doors are mutually slid from its closed state to its open state or is set to an opened position opposite to a closed position before movement.

According to the present invention, the airtight holder similar to that in the conventional double sliding sash system maintains high air-tightness. Meanwhile, each sash door can be arbitrarily opened and closed by sliding and folding.

In another embodiment of the invention, each guide rail has a cutaway communicating portion corresponding to the operation set position. An intermediate interlocking frame of each sash door is engaged to and detached from a corresponding guide rail through the cutaway communicating portion.

According to the present invention, in addition to the above-mentioned function and effect, the intermediate interlocking frame using the cutaway communicating portion can be engaged and disengaged certainly and easily.

In the sash system, the cutaway communicating portion is formed by cutting away a protrusion fin or protrusion wall of each guide rail in a U-shaped form, for engagement and disengagement of the intermediate interlocking frame.

In another embodiment of the invention, the cutaway communicating portion is formed by cutting away a protrusion fin or protrusion wall of each guide rail in an L-shaped form, for engagement and disengagement of the intermediate interlocking frame and for opening of the end of the divider panel.

According to the present invention, in addition to the above-mentioned function and effect, the cutaway communicating portion can be adjusted to the general relationship between the sash door and the sash frame to preferably perform engagement and detachment of the intermediate interlocking frame.

In the sash system, each sash door is arbitrarily moved to an opened position, opposite to a closed arrangement, in two steps including a home position where each sash door is opened and closed slidably and a "let it to go past" position where each sash door is displaced toward the vertical frame of the sash frame, whereby engagement and disengagement of the intermediate interlocking frame is set to the "let it to go past" position.

According to the present invention, in addition to the above-mentioned function and effect, opening/closing of each sash door by sliding and folding can be made at a different position. Meanwhile, because opening/closing through sliding becomes a normal mode, each sash door is not opened in a folded state while being opened by sliding it.

The sash system further comprises a door stopper for sash door movement position selection disposed between a vertical frame of a door end frame of a sash door and a vertical frame of the sash frame, for opening said sash door in the two steps.

According to the present invention, in addition to the above-mentioned function and effect, the simple, easy operation of the door stopper allows the two-step opening movement of each sash door to be selectively performed through sliding and through folding.

In the sash system, the door stopper can stand up or fall vertically or inwardly/outwardly to the door end frame of each sash door or to a vertical frame of a sash frame, whereby a displacement amount to a "let it to go past" position of a corresponding sash door or an effective operation length of each guide rail is varied in response to a standing or falling operation of the door stopper.

According to the present invention, in addition to the above-mentioned function and effect, because the door stopper can rise up and fall, the position where each sash door is opened and closed through sliding and folding can be selected more certainly.

In the sash system, each of the sash doors comprises a door stop framework, a door end frame, two divider panels disposed between the door stop framework and the door end frame, the divider panels having the same width, and a single intermediate interlocking frame disposed at an intermediate portion of each divider panel, whereby each of the sash doors can be quickly folded in a flat, V-shaped form for opening and closing.

In the sash system, each of the sash doors comprises a door stop framework, a door end frame, an even number of divider panels (being at least four divider panels) disposed between the door stop framework and the door end frame, the divider panels having the same width, and an even number of intermediate interlocking frames disposed at an intermediate portion of each divider panel, whereby each of the sash doors can be folded in a concertina form for opening and closing, the concertina form having fold lines corresponding to said even number.

According to the present invention, in addition to the above-mentioned function and effect, the entire basic structure of each sash door is specified while each sash door can be easily folded effectively through folding.

BRIEF DESCRIPTION OF THE DRAWINGS

This and other objects, features, and advantages of the present invention will become more apparent upon a reading of the following detailed description and drawings, in which.

DETAILED DESCRIPTION OF A PREFERRED EMBODIMENT

A sash system that can open and close sash doors through sliding and folding, according to an embodiment of the present invention, will be described below by referring to the attached drawings.

In the embodiment, a sash system is built by assembling a rectangular sash frame integrally formed of upper, lower, right, and left frames, and two sash doors. The two sash doors include an inner sash door and an outer sash door, assembled inside the sash frame. The sash doors can horizontally slide in parallel differently to each other. Each sash door can be folded in two on the right or left side inside the sash frame. A simple changeover mechanism is attached to each sash frame to trigger a two-folded operation of each sash door. Along with the sash door opening/closing function through sliding, the changeover mechanism can arbitrarily perform a sash door opening/closing operation through folding, without disturbing the sash opening/closing operation through the normal sliding operation. Each sash door is opened through folding, if necessary.

Figure 1:
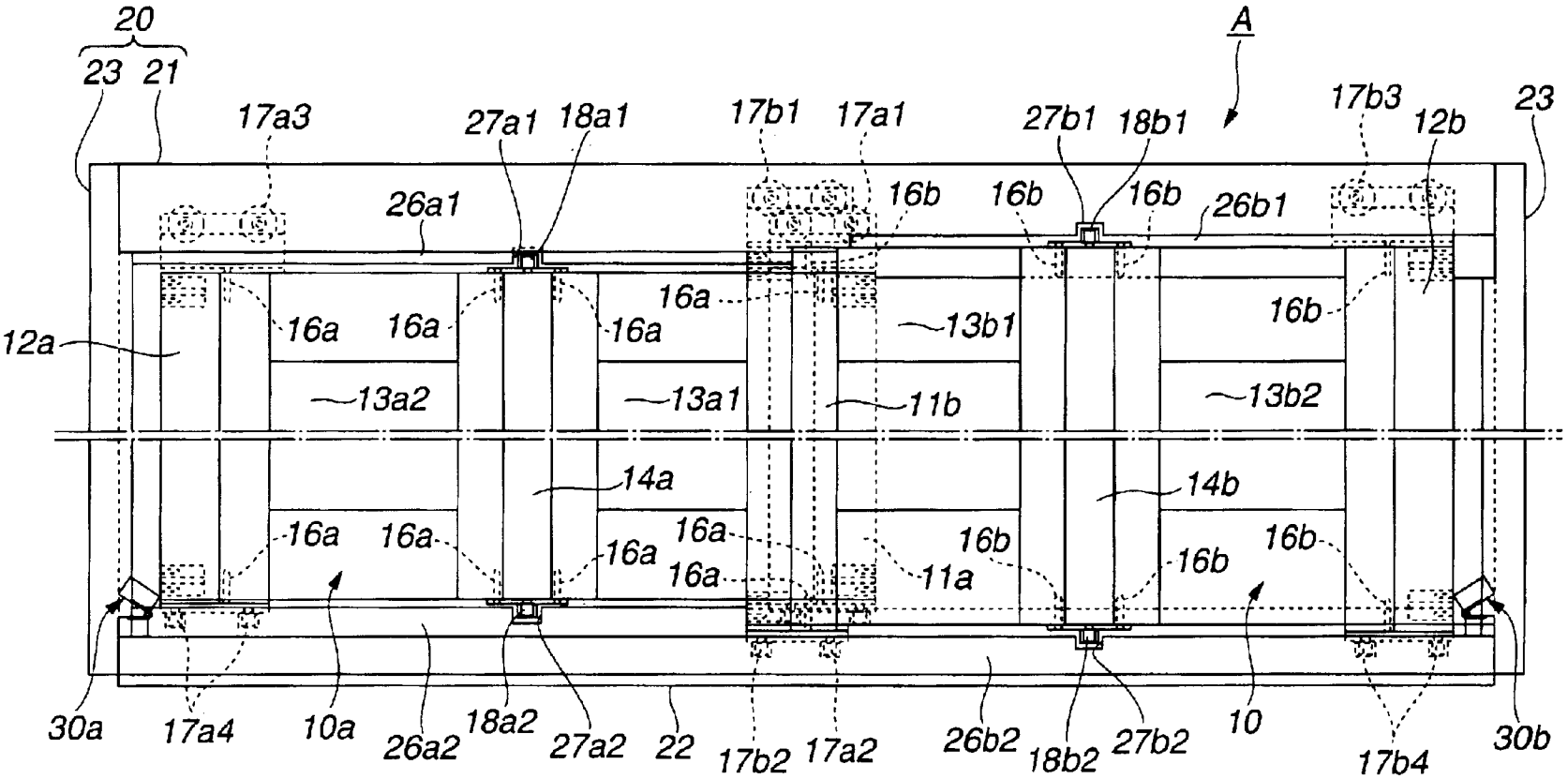
FIG. 1 is a front explanatory diagram fundamentally illustrating the main structure of a sash system according to an embodiment of the present invention, viewed from outside the room, wherein sash doors inside a sash frame are in a prefolding mode in which the sash doors are opened in a "let it go past" state.
Figure 2:
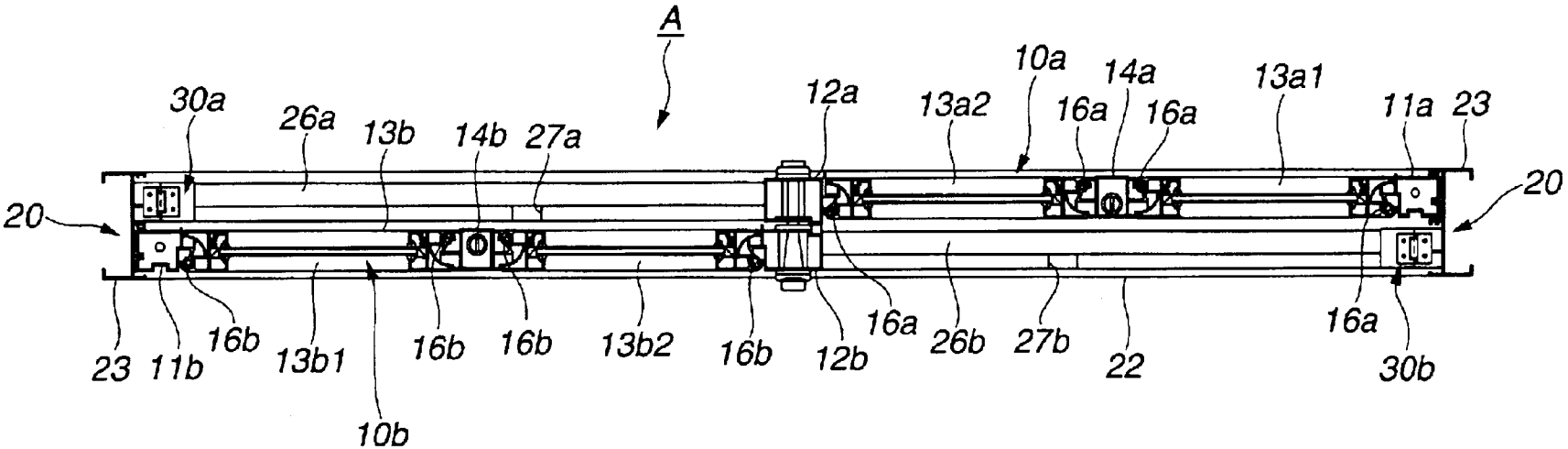
FIG. 2 is a side cross-sectional view illustrating sash doors inside a sash frame, which are normally closed in a double sliding state, the upper portion of FIG. 2 corresponding to an indoor side and the lower portion of FIG. 2 corresponding to an outdoor side.
Figure 3:
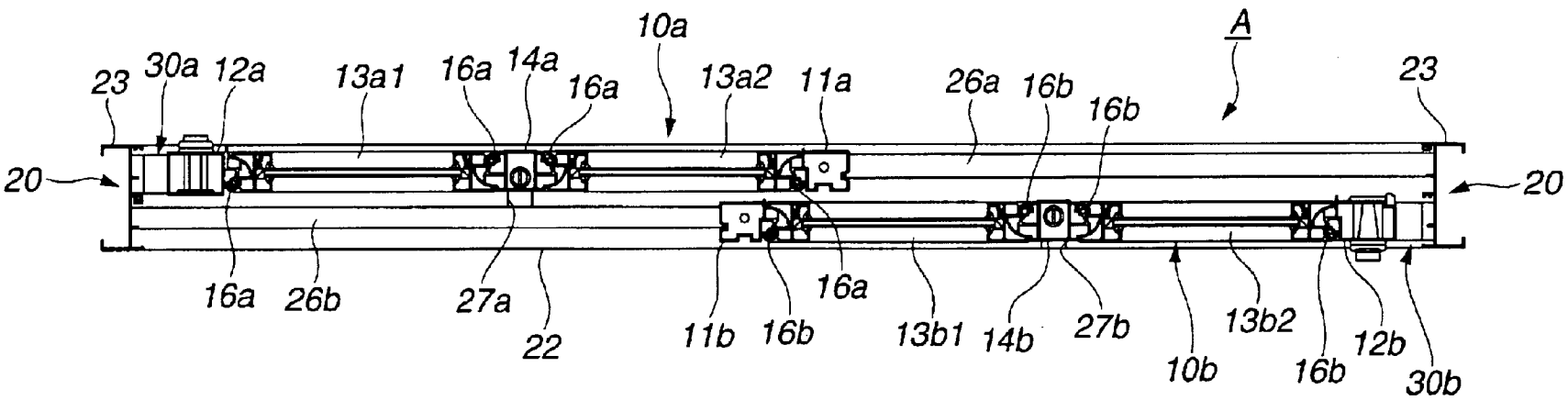
FIG. 3 is a side cross-sectional view illustrating sash doors, which are moved to a "let it go past" position inside a sash frame and corresponds to the state shown in FIG. 1, the upper portion of FIG. 3 corresponding to an indoor side and the lower portion of FIG. 3 corresponding to an outdoor side.
Figure 8:
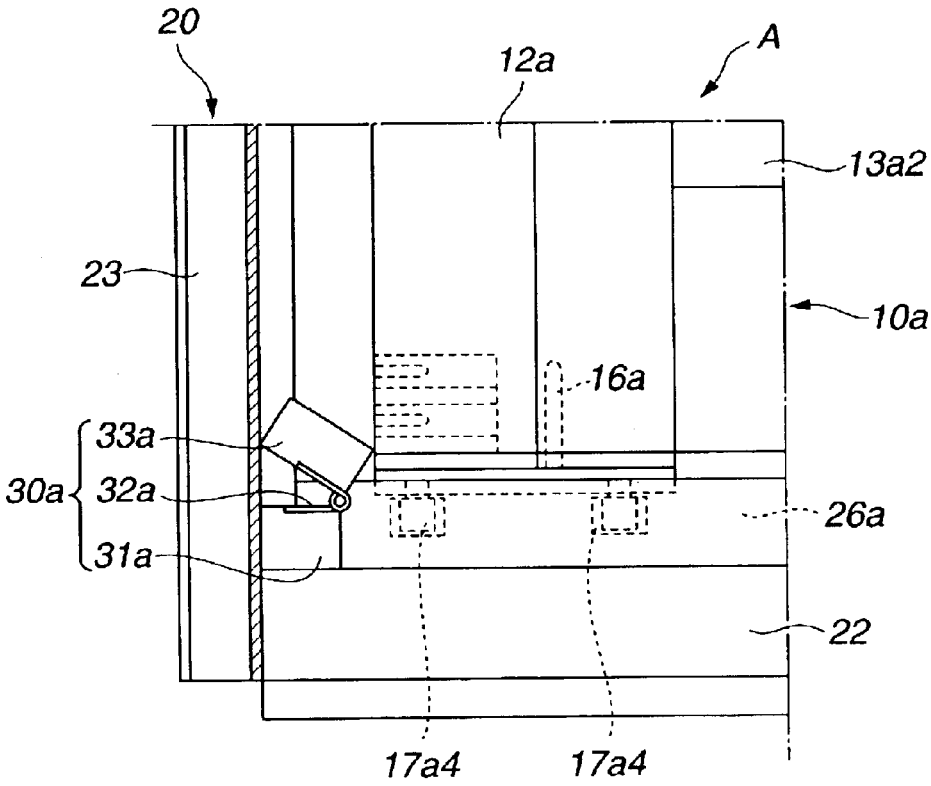
FIG. 8 is an enlarged front view partially illustrating a door stopper after actuation, inside a sash frame, corresponding to the state in FIG. 1, viewed from an outdoor side.

FIGS. 1 and 8 show the main constituent elements of a basic sash system according to an embodiment of the present invention. Both a sash opening/closing function through sliding and a sash opening/closing function through folding are explained here. Particularly, FIGS. 1 to 3 show the state before sash doors are opened through folding. In that state, an inner sash door and an outer sash door are moved to a "let it go past" position inside a sash frame and the intermediate interlocking frame of each sash door confronts a cutaway portion in a corresponding guide rail. FIG. 2 shows the "let it go past" mode of each sash door.

Referring to FIGS. 1 to 8, letter A represents a sash system according to the embodiment, in which sash doors can be freely opened and closed by sliding and folding. Referring to FIGS. 1 to 6, the sash system (A) basically comprises an integrated sash frame 20, and an inner sash door 10*a* and an outer sash door 10*b*, inserted in the sash frame 20. The sash frame 20 is built in a window or entryway of a room. Each sash door 10*a*, 10*b* is suspended to the sash frame 20 so as to travel (to open or close) under guide regulation.

An operation member is disposed to each door as an engagement/disengagement mechanism that selectively opens and closes each sash door 10*a*, 10*b* by folding. As shown in detail in FIGS. 7 and 8, the door stopper 30*a*, acting as the main mechanism which switches opening and closing of the sash door 10*a* by sliding and folding, is disposed to the inner sash door 10*a*. The door stopper 30*b*, acting as the main mechanism which switches opening and closing of the sash door 10*b* by sliding and folding, is disposed to the inner sash door 10*b*.

Figure 5:
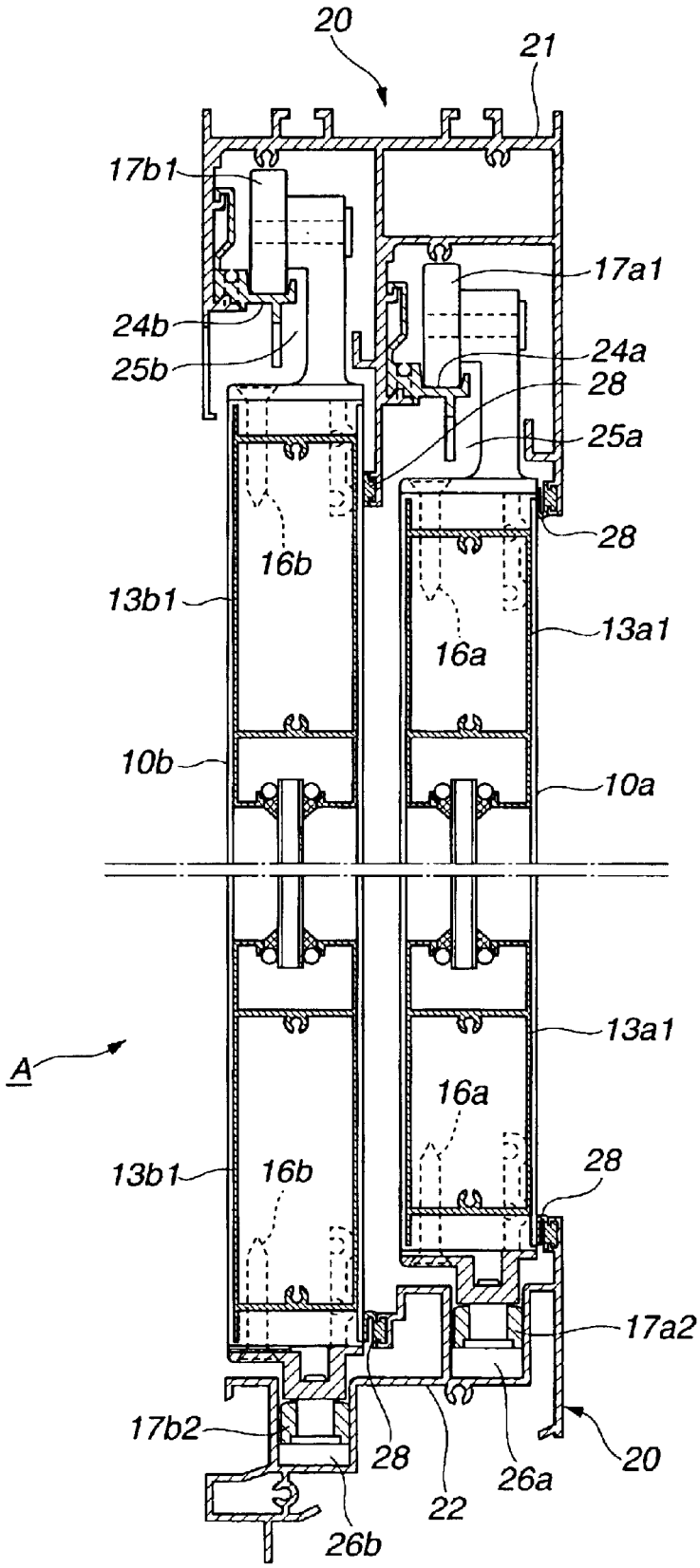
FIG. 5 is a vertical cross-sectional view illustrating an enlarged entire structure, which has a divider panel portion in each sash door inside a sash frame, the upper portion of FIG. 5 corresponding to an indoor side and the lower portion of FIG. 5 corresponding to an outdoor side.
Figure 6:
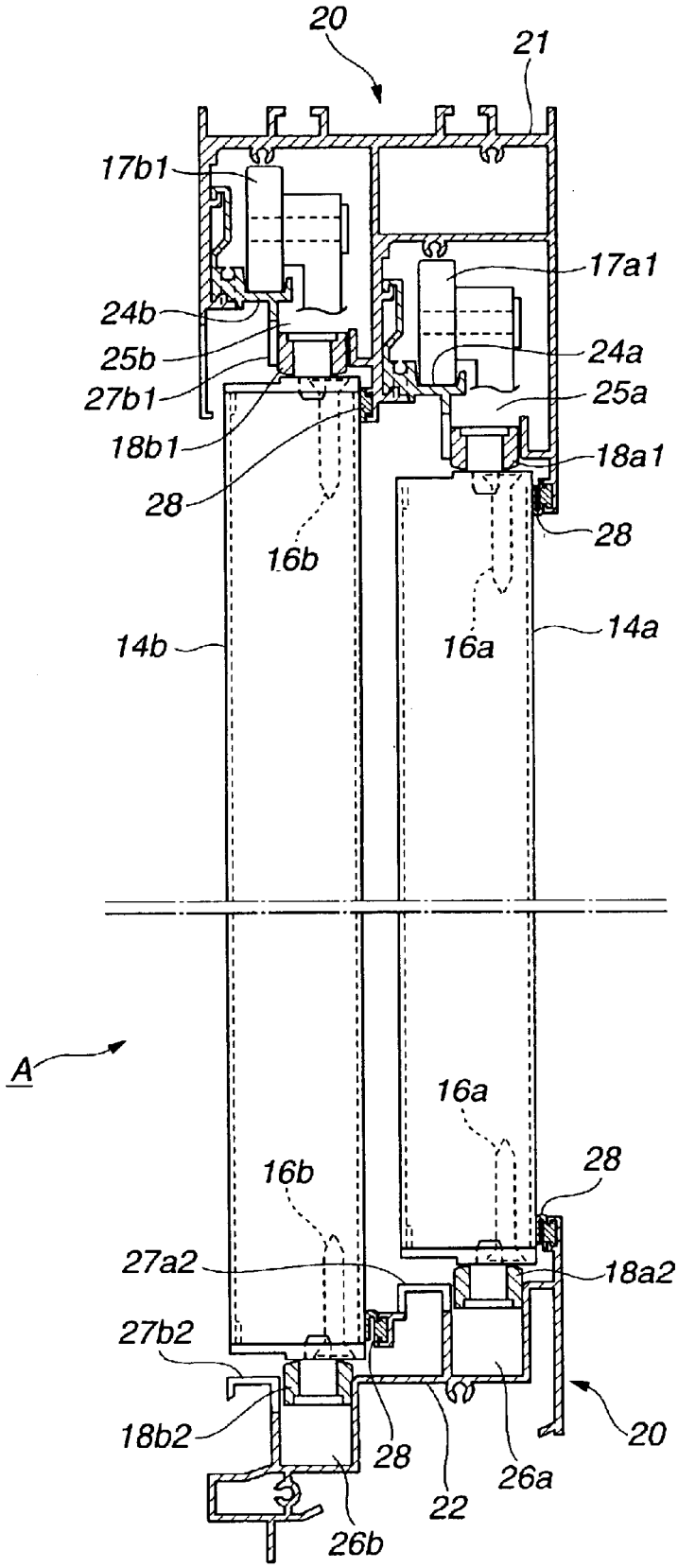
FIG. 6 is a vertical cross-sectional view illustrating an enlarged intermediate linkage portion to each sash door inside a sash frame, corresponding to the state in FIG. 1, the upper portion of FIG. 6 corresponding to an indoor side and the lower portion of FIG. 6 corresponding to an outdoor side.

In uses of the sash door 10*a*, 10*b*, various advantages can be obtained when the window or awning is opened outward by folding. Generally, as shown in FIGS. 5 and 6, the outer (outdoor) sash door 10*b* is slightly higher than the inner (indoor) sash door 10*a*.

The main members and the secondary constituent members associated with them (to be described later) are manufactured effectively and advantageously of, for example, aluminum section bars extruded in a desired cross-sectional shape, and/or composite members formed of aluminum section bars, resin section bars, and wooden section bars.

In the sash system (A), the sash frame 20 is securely fitted in a window or entryway of a room. The inner sash door 10*a* and the outer sash door 10*b* can travel inside the sash frame 20. If necessary, when the door stopper 30*a* is actuated, the sash door 10*a* is drawn against the left inner surface of the sash frame, with the sash door 10*a* folded (refer to FIG. 4). When the door stopper 30*b* is actuated, the sash door 10*b* is drawn against the right inner surface of the sash frame, with the sash door 10*b* folded (refer to FIG. 4).

In other words, the sash door 10*a* has a vertical door front frame 11*a*, a vertical door end frame 12*a*, and foldable divider panels 13*a*1 and 13*a*2. The foldable divider panels 13*a*1 and 13*a*2 are disposed between the door front frame 11*a* and the door end frame 12*a* and are connected together by means of an intermediate interlocking frame 14*a* disposed in the intermediate portion between the door front frame 11*a* and the door end frame 12*a*. The sash door 10*b* has a vertical door front frame 11*b*, a vertical door end frame 12*b*, and foldable divider panels 13*b*1 and 13*b*2. The foldable divider panels 13*b*1 and 13*b*2 are disposed between the door front frame 11*b* and the door end frame 12*b* and are connected together by means of an intermediate interlocking frame 14*b* disposed in the intermediate portion between the door front frame 11*b* and the door end frame 12*b*. (Refer to FIGS. 2 to 4)

As shown in FIGS. 5 and 6, an inner upper suspension roller 17*a*1 for suspension and rolling guide is loaded on the upper end of the door front frame 11*a*. An outer upper suspension roller 17*b*1 for suspension and rolling guide is loaded on the upper end of the door front frame 11*b*. An inner lower roller 17*a*2 for a rolling guide working as anti-vibration (or an inner or lower slush member for a slidable guide) is protruded at the lower end of the door framework 11*a*. An outer lower roller 17*b*2 for a rolling guide working as anti-vibration (or an inner slush member for a slidable guide) is protruded at the outer end of the door front frame 11*b*. Hinges 16*a*, 16*a*, which act as a rotational center for folding with respect to a fixed reference, are respectively fitted on the upper and lower ends of the door front frame 11*a*, 11*b* so as to get close to the outdoor side. (Refer to FIGS. 2 to 4)

This is also the case for the door end frames 12*a* and 12*b*. That is, an inner upper suspension roller 17*a*3 for suspension and rolling guide is loaded on the upper end of the door end frame 12*a*. An outer upper suspension roller 17*b*3 for suspension and rolling guide is loaded on the upper end of the door end frame 12*b*. An inner lower guide roller 17*a*4 for a rolling guide working as anti-vibration (or an inner slush member for a slidable guide) is protruded at the lower end of the door end frame 12*a*. An outer lower guide roller 17*b*4 for a rolling guide working as anti-vibration (or an outer slush member for a slidable guide) is protruded at the lower end of the door end frame 12*b*. Hinges 16*b*, 16*b*, which act as a rotational center for folding with respect to other fixed reference, are respectively attached on the upper and lower ends of the door end frame 12*a*, 12*b* so as to get close to the outdoor side. (Refer to FIGS. 2 to 4)

An inner upper guide roller 18*a*1 and an inner lower guide roller 18*a*2, each for rolling guide acting as an engagement/disengagement portion, respectively protrude from the upper and lower ends of the intermediate interlocking frame 14*a*. An outer upper guide roller 18*b*1 and an outer lower guide roller 18*b*2, each for rolling guide acting as an engagement/disengagement portion, respectively protrude from the upper and lower ends of the intermediate interlocking frame 14*b*. Hinges 16*a* and 16*b* acting as the rotational center with respect to a reference on the movable side are respectively fitted at the upper and lower portions on the interlocking frame 14*a*, 14*b* so as to get close to the indoor side. (Refer to FIG. 1 and FIGS. 5 and 6)

Figure 4:
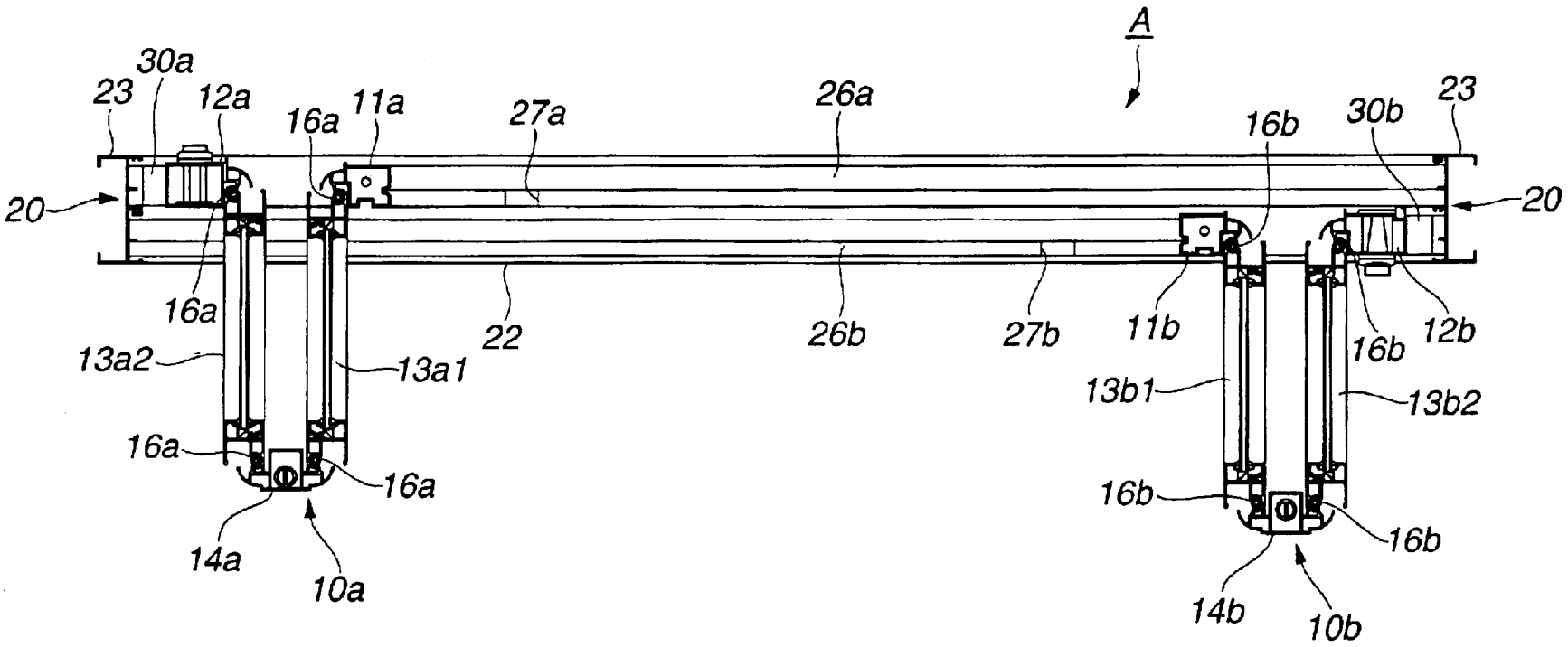
FIG. 4 is a side cross-sectional view illustrating sash doors inside a sash frame, which are opened outdoors through folding, the upper portion of FIG. 4 corresponding to an indoor side and the lower portion of FIG. 4 corresponding to an outdoor side.

In the normal use mode of the inner sash door 10*a* and the outer sash door 10*b*, the sash doors 10*a* and 10*b* are slidably opened and closed under guide regulation by the sash frame 20 (to be described later), in a manner similar to the conventional manner. Specifically, in the closing mode as shown in FIG. 2, the door front frame 11*a* of the inner (indoor) sash door 1O*a* is abutted against the right side vertical sash frame 20, with the sash doors 10*a* and 10*b* being flat (not folded). Thus, the door end frame 12*a* is separated from the left side vertical sash frame 20. The door end frame 11*b* of the outer sash frame 10*b* is abutted against the left side vertical sash frame 20, while the door end frame 12*b* is separated from the right side vertical sash frame 20. Thus, the door end frame 12*a* is aligned to the door end frame 12*b*. Furthermore, as shown in FIG. 4, the sash doors 10*a* and 10*b* can be open and closed through a folding operation. In this operation, the sash doors are folded outward from the room. However, if necessary, the sash doors may be folded inwardly to the room.

That is, in the inner (indoor) sash door 10*a* released from the guide regulation, each of both the door front frame 11*a* and the receiving end frame 12*a* acts as a reference on the fixed side. The intermediate interlocking frame 14*a* acts as a single reference on the movable side. Each hinge 16*a* acts as a rotational center. Thus, the divider panels 13*a*1 and 13*a*2 of the sash door 10*a* can be two-folded right and left in a substantially flat, V-shaped state. (Refer to the left portion of FIG. 4)

Similarly, in the outer (outdoor) sash door 10*b*, released from the guide regulation, each of both the door front frame 11*b* and the receiving frame 12*b* acts as a reference on the fixed side. The intermediate interlocking frame 14*b* acts as a single reference on the movable side. Each hinge 16*b* acts as a rotational center. Thus, the divider panels 13*b*1 and 13*b*2 of the sash door 10*b* are two-folded right and left in a substantially flat, V-shaped state. (Refer to the right portion of FIG. 4)

As well known, the sash frame 20 is integrally assembled of the upper horizontal frame 21, the lower horizontal frame 22, the right vertical frame 23, and the left vertical frame 23, to form a rectangular sash space.

An inner upper guide rail 24*a*, an outer upper guide rail 24*b*, an inner upper guide rail 25*a*, and an outer guide rail 25*b* are integrally built in the upper horizontal frame 21 (mainly refer to FIG. 1). The inner upper guide rail 24*a* supports an inner upper suspension roller 17*a*1 by suspension and rotatably guides it. The outer upper guide rail 24*b* supports an outer upper suspension roller 17*b*1 by suspension and rotatably guides it. The upper guide rail 25*a* is disposed in parallel to the inner upper guide rail 24*a*. The upper guide rail 25*a* guides the upper guide roller 18*a*1 so as to prevent vibration thereof. The upper guide rail 25*b* is disposed in parallel to the inner upper guide rail 24*b*. The upper guide rail 25*b* guides the upper guide roller 18*b* so as to prevents vibration thereof. (The inner upper guide rail 25*a* may be substituted for the upper guide rail 24*a*. The outer upper guide rail 25*b* may be substituted for the upper guide rail 24*b*.)

A communicating portion 27*a*1, 27*b*1 cut away in a U-shaped form is used as a passage for engagement and disengagement of the upper guide roller 18*a*1, 18*b*1 (refer to FIG. 1 and FIGS. 5 and 6). The communicating portion 27*a*1, 27*b*1 is formed at the position (to be described in detail later) where a protrusion fin extends downward on the outside of the upper guide rail 25*a*, 25*b*. In some cases, the cutaway communicating portion 27*a*1, 27*b*1 may be cut in an L-shape to open the end of the divider panel 13*a*1, 13*a*2.

Moreover, the inner lower guide rail 26*a* is integrally built in the lower horizontal frame 22 to prevent vibration of the inner lower guide roller 18*a*2. The outer lower guide rail 26*b* is integrally built in the lower horizontal frame 22 to prevent vibration of the outer lower guide roller 18*b*2. A U-shaped cutaway communicating portion 27*a*, acting as a passage for engagement and disengagement of the lower guide roller 18*a*2, is formed in a corresponding portion (to be described later) of the wall protruded from the outer surface of the inner lower guide rail 26*a*. A U-shaped cutaway communicating portion 27*b*, acting as a passage for engagement and disengagement of the lower guide roller 18*b*2, is formed in a corresponding portion (to be described later) of the wall protruded from the outer surface of the outer lower guide rail 26*b*. (Refer to FIG. 1 and FIGS. 5 and 6)

Referring to FIGS. 5 and 6, numeral 28 represents an elastic airtight member attached to a corresponding portion. The airtight member 28 can effectively seal hermetically the entire system.

Each of the inner door stopper 30*a* and the outer door stopper 30*b* can rise vertically (or outwardly or inwardly), turn, and fall. Only the inner (indoor) door stopper 30*a* is shown in FIGS. 7 and 8.

In the closing mode as shown in FIG. 2, the side of the left vertical frame 23 is opened by sliding the door front frame 11*a* of the sash door 10*a* against the right vertical frame 23 of the sash frame 20. In such a closing mode, the inner door stopper 30*a* is inserted between the left vertical frame 23 corresponding to the open side and the left, lower, inner surface of the lower guide rail 26*a*. The left end of the inner door stopper 23 butts against the vertical frame 23 (refer to FIGS. 7 and 8).

Moreover, the outer (outdoor) door stopper 30*b* is not shown in an enlarged state. However, as apparent from FIG. 1, the outer door stopper 30*b* is disposed symmetrically to the inner door stopper 30*a*. In the closing mode, the side of the write vertical frame 23 is opened by sliding the door front frame 11*b* of the sash door 10*b* against the left vertical frame 23 of the sash frame 20. In such a closing mode, the outer (outdoor) door stopper 30*b* is inserted between the right vertical frame 23 corresponding to the open side and the right, lower, inner surface of the lower guide rail 26*b*. The right end of the outer door stopper 30*b* butts against the right vertical frame 23.

Figure 7:
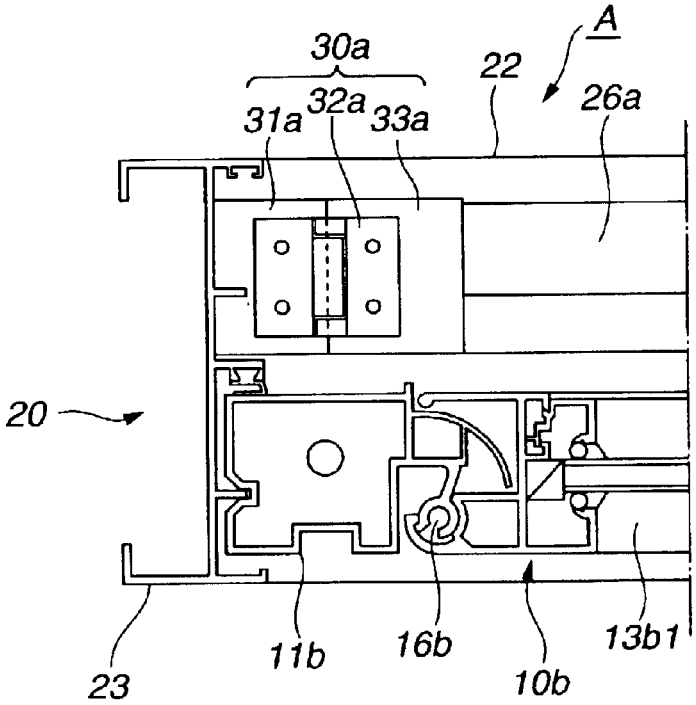
FIG. 7 is a cross sectional view partially illustrating a door stopper before actuation, inside a sash frame, corresponding the state in FIG. 2, the upper portion of FIG. 7 corresponding to an indoor side and the lower portion of FIG. 7 corresponding to an outdoor side.

FIGS. 7 and 8 show the door end stopper 30*a* for the inner sash door but do not show the door end stopper for the outer sash door because of the equivalent arrangement. The door end stopper 30*a* (30*b* in temporary number) is formed of a fixed base block 31*a* fixed directly on the lower, inner surface of the lower guide rail 26*a* (26*b*) and a movable block 32*a* (32*b*) supported rotatably to the fixed base block 31*a* (31*b*) by means of the hinge 32*a* (32*b*). In this example, the movable block 33*a* (33*b*) can stand up in the rail guide direction or fall down.

In the door end stopper 30*a* (30*b*) as shown in FIG. 8, the movable block 33*a* (33*b*) rotatably falls toward the fixed base block 31*a* (31*b*) so that the door stopper is expanded to a predetermined length. As a result, the effective operation length of the inner lower guide rail 26*a* is shortened. In other words, when the door stopper 30*a* (30*b*) expands, the effective operational lengths of the inner lower guide rail 26*a* in the sash door 10*a* and the outer lower guide rail 26*b* in the sash door 10*b* are substantially shorter than the length to the vertical frame 23. This is also the case for the inner upper guide rail 25*a* in the sash door 10*a* and the outer upper guide rail 25*b* in the sash door 10*b*.

By doing so, the effective operation, or the double sliding operation, between the closed position and the opened position of each sash door 10*a*, 10*b* is restricted to the shortened length. The open end of the door end frame 12*a*, 12*b* of the sash door 10*a*, 10*b* directly strikes the movable block 33*a* (32) expanded. Thus, further movement of the sash door 10*a*, 10*b*, that is, movement to the "let it go past" position is restricted. As a result, displacement to the "let it go past" position of each sash door 10*a*, 10*b* is disabled, through which each sash door 10*a*, 10*b* is changed from the expansion state (or opening/closing through sliding) to a laterally two-folded state (or opening/closing through folding).

For that reason, in the sash door 10*a*, the upper guide rail 25*a* guides the upper guide roller 18*a*1 and the lower rail 26*a* guides the lower guide roller 18*a*2. In the sash door 10*b*, the upper guide rail 25*b* guides the upper guide roller 18*b*1 and the lower rail 26*b* guides the lower guide roller 18*b*2. This operation allows the divider panels 13*a*1 and 13*a*2 to slide in a normally expanded state. As a result, the sash door 10*a*, 10*b* can be effectively opened and closed through the double sliding operation.

The movable block 33*a* (33*b*) rises up rotatably to the fixed base block 31*a* (31*b*) to change the operation mode, as shown in FIG. 8. Thus, the entire operation length is shortened to a predetermined value. This allows the effective operation length of the outer lower guide rail 26*a* to be extended. In other words, when the door stopper 30*a*, 30*b* is shortened, the effective operation lengths of the inner lower guide rail 26*a* and the inner upper guide rail 25*a* in the sash door 10*a* are substantially prolonged by the shortened length to the vertical frame 23. Similarly, the effective operation length of each of the inner lower guide rail 26*b* and the inner upper guide rail 25*b* in the sash door 10*b* is substantially prolonged by the shortened length to the vertical frame 23.

Thus, the effective operation range of the sash door 10*a*, 10*b* in the sliding operation is prolonged by the reduced length. The cutaway communicating portion 27*a*1 is set within only the reduced length range in the upper guide rail 25*a*. The cutaway communicating portion 27*b*1 is set within only the reduced length range in the upper guide rail 25*b*. The cutaway communicating portion 27*a*2 is set within only the reduced length range in the lower guide rail 26*a*. The cutaway communicating portion 27*b*2 is set within only the reduced length range in the lower guide rail 26*b*.

In such a case, the open end of the door end frame 12*a*, 12*b* of the sash door 10*a*, 10*b* can additionally move until it directly strikes the movable block 32*a* (32*b*) of a reduced length, thus performing the "let it go past" movement. Thus, the sash door 10*a*, 10*b* can be displaced to the "let it go past" position to change the mode to a laterally two-folded state (corresponding to opening/closing through folding) from an expanded state (corresponding to opening/closing through double sliding).

In the sash door 10*a*, the upper guide rail 25*a* guides the upper guide roller 18*a*1 while the lower guide rail 26*a* guides the lower guide roller 18*a*2. In the sash door 10*b*, the upper guide rail 25*b* guides the upper guide roller 18*b*1 while the lower guide rail 26*b* guides the lower guide roller 18*b*2. Thus, the sash doors 10*a* and 10*b* are slid to establish the arrangement opposite to the closed arrangement, as shown in FIGS. 1 and 3. During the "let it go past" operation, the upper guide roller 18*a*1 comes in contact with the upper cutaway communicating portion 27*a*1. Similarly, the upper guide roller 18*b*1 comes in contact with the upper cutaway communicating portion 27*b*1. The lower guide roller 18*a*2 comes in contact with the lower cutaway communicating portion 27*a*2. The lower guide roller 18*b*2 comes in contact with the upper cutaway communicating portion 27*b*2.

In the sash door 10*a*, the upper guide roller 18*a*1 engages with the upper guide rail 25*a* through the upper cutaway communicating portion 27*a*1. The lower guide roller 18*a*2 engages with the lower guide rail 26*a* through the lower cutaway communicating portion 27*a*2. In the sash door 10*b*, the upper guide roller 18*b*1 engages with the upper guide rail 25*b* through the upper cutaway communicating portion 27*b*1 (in a slide opening/closing state). The lower guide roller 18*b*2 engages with the lower guide rail 26*b* through the lower cutaway communicating portion 27*b*2. By starting with such an engagement state (an opening/closing state), the sash door 10*a*, 10*b* can be pushed out through separating or can be re-engaged inwardly through pushing. As a result, the window can be fully opened by folding the sash door 10*a*, 10*b*, as shown in FIG. 4.

That is, opening through sliding or opening through folding of the sash door 10*a*, 10*b* can be selected arbitrarily.

The door stopper 30*a*, being an engagement/disengagement mechanism to select the opening/closing operations, can be easily realized by means of a simple mechanism that can merely change the effective operation length of each of the guide rails 25*a* and 26*a*. The operation member 30*b*, being an engagement/detachment mechanism to select the opening/closing operations, can be easily realized by means of a simple mechanism that can merely change the effective operation length of each of the guide rails 25*b* and 26*b*

The present invention should be noted that further various modifications are possible, without being limited to only the above-mentioned embodiments. For example, each sash door may have divider panels of even numbers, which are foldable into concertina form. The door stopper may be an engagement/detachment mechanism detachable from each guide rail or from each sash frame. The door stopper may be firmly fixed on a corresponding door end frame. Various changes and modifications may be made without departing from the spirit or scope of the present invention.

What is claimed is:

1. A sash system comprising:

a pair of sash doors including an inner sash door and an outer sash door, each of said sash doors including a vertical door front frame disposed on the right end of each sash door, a vertical door end frame disposed on the left end of each sash door, a pair of horizontal divider panels joined by an intermediate locking frame and connecting said door front frame and said end frame, said intermediate interlocking frame being foldable with respect to a vertical rotational shaft thereof;

an upper sash frame and a lower sash frame; and an inner guide rail built in said upper frame and an outer guide rail built in said lower frame, said door front frame and said door end frame corresponding to each sash door being engaged with said inner guide rail and with said outer guide rail, respectively;

said intermediate interlocking frame being engaged so as to be detachable from at least one of said inner guide rail, said outer guide rail, and an interlocking frame guide rail in parallel to each of said inner and outer guide rails;

wherein said sash system has a first mode and a second mode, in said first mode, at least one of said sash doors is slidably movable between an open state and a closed state while in an intermediate interlocking frame engaged state, and in said second mode, said at least one of said sash doors is folded in an intermediate interlocking frame disengaged state by folding said intermediate locking frame of said at least one of said sash doors about said vertical shaft of said intermediate locking frame.

2. The sash system as defined in claim 1, wherein each guide rail has a cutaway communicating portion corresponding to an operation set position, whereby an intermediate interlocking frame of each sash door is engaged to and detached from a corresponding guide rail through said cutaway communicating portion.

3. The sash system as defined in claim 2, wherein at least one of said guide rails includes at least one of a protrusion fin and a protrusion wall, and said cutaway communicating portion is formed by cutting away at least one of said protrusion fin and said protrusion wall of each guide rail in a U-shaped form, for engagement and disengagement of said intermediate interlocking frame.

4. The sash system as defined in claim 2, wherein at least one of said guide rails includes at least one of a protrusion fin and a protrusion wall, and said cutaway communicating portion is formed by cutting away at least one of said protrusion fin and said protrusion wall of each guide rail in an L-shaped form, for engagement and disengagement of said intermediate interlocking frame and for opening of an end of one of said divider panels of one of said sash doors.

5. The sash system as defined in claim 1, wherein each sash door is arbitrarily moved to an opened position, opposite to a closed arrangement, in two steps including a home position where each sash door is opened and closed slidably and a disengagement position where each sash door is displaced toward the vertical frame of said sash frame, and engagement and disengagement of said intermediate interlocking frame of at least one of said sash doors is accomplished when said one of said sash doors is in said disengagement position.

6. The sash system as defined in claim 5, further comprising:

a door stopper for sash door movement position selection disposed between a vertical frame of a door end frame of a sash door and a vertical frame of said sash frame, for opening said sash door in said two steps.

7. The sash system as defined in claim 6, wherein said door stopper can perform a function selected from a group consisting of stand up, fall vertically, fall inwardly, and fall outwardly relative to at least one of said door end frame of each sash door and a vertical frame of a sash frame, whereby a displacement amount to said disengagement position of least one of a corresponding sash door and an effective operation length of each guide rail is varied in response to performance of said function of said door stopper.

8. The sash system as defined in claim 1, wherein each of said sash doors comprises a door stop framework, a door end frame, two divider panels disposed between said door stop framework and said door end frame, said divider panels having the same width, and a single intermediate interlocking frame disposed at an intermediate portion of each divider panel, whereby each of said sash doors can be quickly folded in a flat, V-shaped form for opening and closing.

9. The sash system as defined in claim 1, wherein each of said sash doors comprises a door stop framework, a door end frame, an even number of divider panels being at least four divider panels disposed between said door stop framework and said door end frame, said divider panels having the same width, and an even number of intermediate interlocking frames disposed at an intermediate portion of each divider panel, whereby each of said sash doors can be folded in a concertina form for opening and closing, said concertina form having fold lines corresponding to said even number.

10. A sash system comprising:

a pair of sash doors including an inner sash door and an outer sash door, each of said sash doors including a vertical door front frame, a vertical door end frame, a pair of horizontal divider panels joined by an intermediate locking frame and connecting said door front frame and said end frame, said intermediate interlocking frame being foldable with respect to a vertical rotational shalt thereof;

an upper sash frame and a lower sash frame; and an inner guide rail built in said upper frame and an outer guide rail built in said lower frame, said door front frame and said door end frame corresponding to each sash door being engaged with said inner guide rail and with said outer guide rail, respectively;

said intermediate interlocking frame being engaged so as to be detachable from an interlocking frame guide rail parallel to said inner and outer guide rails.

11. The sash system as in claim 10, in which said interlocking frame guide rail is at least one of said inner guide rail and said outer guide rail.

12. The sash system as in claim 10, in which said sash system has a first mode and a second mode, wherein in said first mode, said sash doors are slidably moved between an open state and a closed state while in an intermediate interlocking frame engaged state, and in said second mode, each of said sash doors are folded in an intermediate interlocking frame disengaged state.

13. The sash system as defined in claim 10, wherein each guide rail has a cutaway communicating portion corresponding to an operation set position, whereby an intermediate interlocking frame of each sash door is engaged to and detached from a corresponding guide rail through said cutaway communicating portion.

14. The sash system as defined in claim 13, wherein at least one of said guide rails includes at least one of a protrusion fin and a protrusion wall, and said cutaway communicating portion is formed by cutting away at least one of said protrusion fin and said protrusion wall of each guide rail in a U-shaped form, for engagement and disengagement of said intermediate interlocking frame.

15. The sash system as defined in claim 13, wherein at least one of said guide rails includes at least one of a protrusion fin and a protrusion wall, and said cutaway communicating portion is formed by cutting away at least one of said protrusion fin and said protrusion wall of each guide rail in an L-shaped form, for engagement and disengagement of said intermediate interlocking frame and for opening of an end of one of said divider panels of one of said sash doors.

16. The sash system as defined in claim 10, wherein each sash door is arbitrarily moved to an opened position, opposite to a closed arrangement, in two steps including a home position where each sash door is opened and closed slidably and a disengagement position where each sash door is displaced toward the vertical frame of said sash frame, and engagement and disengagement of said intermediate interlocking frame of at least one of said sash doors is accomplished when said one of said sash doors is in said disengagement position.

17. The sash system as defined in claim 16, further comprising:

a door stopper for sash door movement position selection disposed between a vertical frame of a door end frame of a sash door and a vertical frame of said sash frame, for opening said sash door in said two steps.

18. The sash system as defined in claim 17, wherein said door stopper can perform a function selected from a group consisting of stand up, fall vertically, fall inwardly, and fall outwardly relative to at least one of said door end frame of each sash door and a vertical frame of a sash frame, whereby a displacement amount to said disengagement position of at least one of a corresponding sash door and an effective operation length of each guide rail is varied in response to performance of said function of said door stopper.

19. The sash system as defined in claim 10, wherein each of said sash doors comprises a door stop framework, a door end frame, two divider panels disposed between said door stop framework and said door end frame, said divider panels having the same width, and a single intermediate interlocking frame disposed at an intermediate portion of each divider panel, whereby each of said sash doors can be quickly folded in a flat, V-shaped form for opening and closing.

20. The sash system as defined in claim 10, wherein each of said sash doors comprises a door stop framework, a door end frame, an even number of divider panels being at least four divider panels disposed between said door stop framework and said door end frame, said divider panels having the same width, and an even number of intermediate interlocking frames disposed at an intermediate portion of each divider panel, whereby each of said sash doors can be folded in a concertina form for opening and closing, said concertina form having fold lines corresponding to said even number.

* * * * *

UNITED STATES PATENT AND TRADEMARK OFFICE

CERTIFICATE OF CORRECTION

PATENT NO. : 6,820,675 B2
DATED : November 23, 2004
INVENTOR(S) : Nakatani

It is certified that error appears in the above-identified patent and that said Letters Patent is hereby corrected as shown below:

Column 13,
Line 13, “shalt” should be -- shaft --

Signed and Sealed this

Nineteenth Day of April, 2005

JON W. DUDAS
*Director of the United States Patent and Trademark Office*